US005131312A

United States Patent [19]

Macor

[11] Patent Number: 5,131,312

[45] Date of Patent: Jul. 21, 1992

[54] SURFACE CONFORMING, TORQUE ENHANCING WRENCH

[76] Inventor: Richard J. Macor, 561 A-1 New Village Rd., Stewartsville, N.J. 08886

[21] Appl. No.: 788,886

[22] Filed: Nov. 7, 1991

Related U.S. Application Data

[63] Continuation-in-part of Ser. No. 409,029, Sep. 18, 1989, and a continuation-in-part of Ser. No. 416,122, Oct. 2, 1989.

[51] Int. Cl.[5] ..... B25B 13/02

[52] U.S. Cl. ..... 81/119; 81/121.1; 81/124.3; 81/124.7; 81/186

[58] Field of Search ..... 81/119, 121.1, 124.3, 81/124.6, 124.7, 186

[56] References Cited

U.S. PATENT DOCUMENTS 3,125,910 3/1964 Kavalar .
3,247,775 3/1966 Hinkle .
3,414,090 3/1966 Raptis .
3,695,124 10/1972 Myers .
3,881,377 5/1975 Evans et al. ..... 81/119 X
4,361,412 11/1982 Stolarczyk ..... 81/124.3 X
4,512,220 4/1985 Barnhill et al. ..... 81/121.1
4,598,616 7/1986 Colvin ..... 81/124.3 X
4,882,957 11/1989 Wright et al. ..... 81/121.1

*Primary Examiner*—James G. Smith
*Attorney, Agent, or Firm*—Kenneth P. Glynn

[57] ABSTRACT

The present invention involves a wrench for tightening and loosening bolts, nuts and fasteners having n number of equal length outside working surfaces. The wrench has a working wrench head with an orifice which contains at least two pairs of flat inside working surfaces. The pairs of inside working surfaces are arranged about and equidistant from an imaginary central axis through the orifice, and the surfaces of each pair form a surface contact angle a with one another. A handle which, is removably or permanently connected to the working wrench head and adapted for rotation of the working wrench head. In one preferred embodiment, the wrench has at least two pairs of surface contact angles that are directly opposite one another.

32 Claims, 3 Drawing Sheets

SURFACE CONFORMING, TORQUE ENHANCING WRENCH

REFERENCES TO RELATED APPLICATIONS

This application is a continuation-in-part of U.S. patent application Ser. No. 07/409,029, filed on Sep. 18, 1989, by the inventor herein, entitled "Open-End Wrench Head". This application is also a continuation-in-part of U.S. patent application Ser. No. 07/416,122, filed on Oct. 2, 1989, by the inventor herein, entitled "Open-End Wrench Head".

BACKGROUND OF THE INVENTION

1. Field of the Invention

The present invention relates to a wrench which has unique pairs of inside working surfaces developed to reduce or eliminate slippage and other conventional wrench problems and to provide for surface-to-surface contact instead of point-to-point contact during high torque usage. The present invention wrench may be any of the known types of wrenches including open-end, box-end, adjustable, socket, etc.

2. Prior Art Statement

Various types of wrenches having conventional configurations to conform to the exact shape of nuts, bolts and fasteners with which they are used have, by necessity, tolerances and clearances which create problems when substantial torque is applied to the wrenches. Recent developments in the art have been directed to the reduction of slip and wear of fastener corners by conventional wrenches.

For example, U.S. Pat. No. 3,125,910 issued to Kavalar describes a wrench having at least 10 cylindrical lobes for equalizing torque exertion. U.S. Pat. No. 3,241,409 to Raptis describes a box wrench having a pivotally, slidably disposed torquing element for relative movement of opposite contact surfaces within the wrench opening during application of torque. This device requires substantial manufacturing with moving parts.

U.S. Pat. No. 3,242,775 to Hinkle describes a wrench for engaging nut contact surfaces to inhibit marring. Curved wrench surfaces are utilized for contact surfaces of the wrench head, and angles vary along these contact surfaces to have a first, then a second portion contact the nut sequentially with increased torquing.

U.S. Pat. No. 3,695,124 to Myers describes angular wrench head with arcuated ribs for rounded point contact with fasteners.

Notwithstanding attempts in the prior art to overcome the substantial deficiencies of standard wrenches none of the prior art teaches or renders obvious the improved wrench of the present invention.

SUMMARY OF THE INVENTION

The present invention involves a wrench for tightening and loosening bolts, nuts and fasteners having n number of equal length outside working surfaces. The wrench has a working wrench head with an orifice which contains at least two pairs of flat inside working surfaces. The pairs of inside working surfaces are arranged about and equidistant from an imaginary central axis through the orifice, and the surfaces of each pair form a surface contact angle A with one another. A handle, which is removably or permanently connected to the working wrench head and adapted for rotation of the working wrench head. In one preferred embodiment, the wrench has at least two pairs of surface contact angles that are directly opposite one another.

BRIEF SUMMARY OF THE DRAWINGS

The present invention as described in this specification will be more fully understood when taken in conjunction with the drawings appended hereto, wherein.

DETAILED DESCRIPTION OF THE PRESENT INVENTION

The present invention is directed to a wrench for tightening and loosening bolts, nuts and fasteners which generally have a specified number of outside working surfaces of equal length. The present invention wrench may take the form of any known wrench such as an open-end wrench, a box-end wrench, a socket wrench, an adjustable wrench or the like, but has unique pairs of inside working surfaces as more fully described below. By "fasteners" is meant any object which may be rotated for tightening or loosening with a wrench of some sort.

It is an object of the present invention to provide a wrench head which eliminates the problems which are inherent with conventional wrenches. These problems arise from the fact that conventional wrenches customarily have fastener engaging orifices with planar or flat surfaces arranged in directly opposite parallel pairs which are arranged in a shape duplicating and or paralleling all or a portion of the outside working surfaces of nuts, bolts or fasteners with which they are used. Although standardized dimensions, tolerances and clearances have been adapted by the wrench manufacturers, the "free swing" resulting from the clearances coupled with some metal distortion of the wrench upon torque, result in wrench surface to fastener surface separation and only point to point contact when torque is applied. Point to point contact is inferior to surface to surface contact because point to point contact may result in damage to the corners of the nut, bolt or fastener so that the wrench may ultimately not work and slip around the head of a tightly fastened nut, bolt or fastener. Also, damage and wear will eventually occur to wrench.

Thus, the present invention is specifically directed to avoiding point to point contact for high torquing wrench usage and achieving surface to surface contact between the wrench and the nut, bolt or fastener for enhanced torque capabilities.

Figure 1:
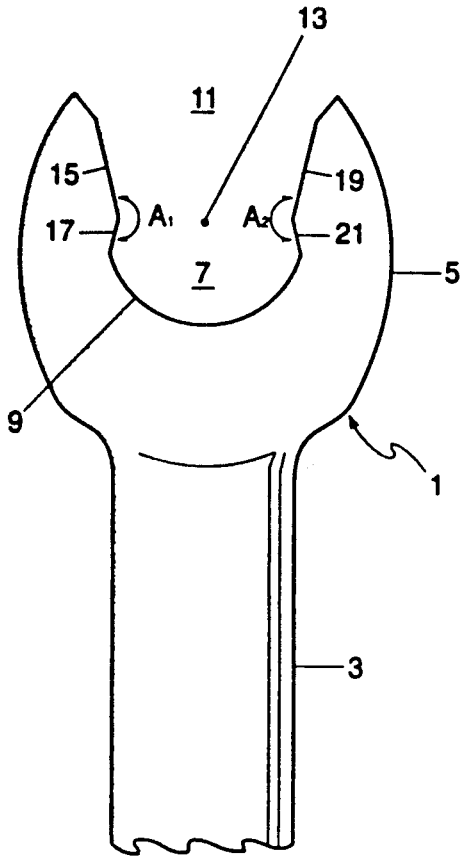
FIG. 1 shows a front cut view of a present invention open-ended wrench having two pairs of flat inside working surfaces.

Referring now to FIG. 1, there is shown a present invention wrench 1 with handle 3, in a partial front view. Working wrench head 5 has an orifice 7 with open end 11 and imaginary central axis 13. Orifice 7 has two pairs of inside working surfaces. One pair is formed by flat inside working surfaces 15 and 17 and the other by flat inside working surfaces 19 and 21. Surfaces 15 and 17 form angle $A_1$ and surfaces 19 and 21 form angle $A_2$. Angles $A_1$ and $A_2$ may be the same or slightly different and are preferably the same. These angles are herein referred to as surface contact angles.

Generally, the present invention wrenches have surface contact angles A, which are equal to or greater than 200° and equal to or less than 220°. Desirably, the surface contact angle A is equal to or greater than 203° and is equal to or less than 217°. Preferably it is an angle equal to or greater than 206° and equal to or less than 214°. In the most preferred embodiments, the surface contact angle is approximately 210°.

Figure 2:
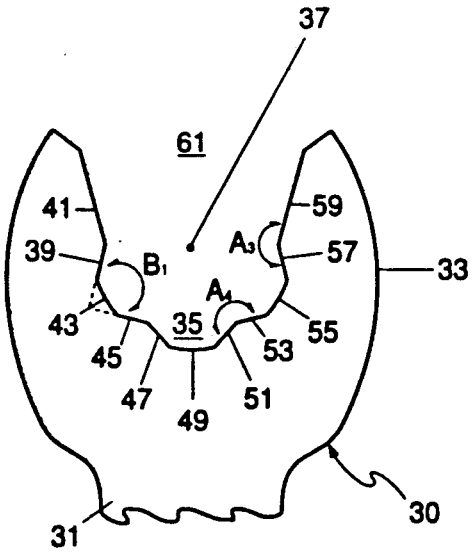
FIG. 2 is a front cut view of a present invention open-ended wrench having four pairs of flat inside working surfaces.

FIG. 2 illustrates a present invention wrench 30 with handle 31, in a partial front view. Working wrench head 33 has an orifice 35 with open end 61 and imaginary central axis 37. Orifice 35 has four pairs of inside working surfaces. One pair is formed by flat contact surfaces 39 and 41 and adjacent thereto is arcuated surface 43, followed by a second pair of flat contact surfaces 45 and 47. Next is arcuated surface 49, followed by a third pair of flat contact surfaces 51 and 53. Surfaces 57 and 59 form the fourth pair of flat contact working surfaces and are separated from the third pair by arcuated surface 55. Examples of the surface contact angles formed are angles $A_3$ and $A_4$, each equal to approximately 209°, preferably 210°, for example. Typical of angles separating the pairs of flat contact surfaces is angle B, which separates surface 39 from surface 45 and is equal to about 90° to 92°, although angle B will be dependent upon the locations and number of pairs, and will thus be dependent upon the number of surfaces n, upon which the wrench will be used. Also, angle B may be calculated based on an imaginary pattern of pairs of flat contact surfaces arranged symmetrically and equidistantly with the number of such pairs equal to the number of outside working surfaces on a fastener to which the wrench may be applied. Generally angle B can be determined by the following formula:

$$B \geqq 140^\circ - (360^\circ/n) \quad \text{(i)}$$

and are equal to or less than the angle calculated by the formula:

$$B \leqq 160^\circ - (360^\circ/n) \quad \text{(ii)}$$

where n is the number of outside working surfaces of bolts, nuts and fasteners for which the wrench is to function, and n is at least 3.

In preferred embodiments, the present invention wrenches have angles B calculated by the formula:

$$B \geqq 143^\circ - (360^\circ/n) \quad \text{(iii)}$$

and are equal to or less than the angle calculated by the formula:

$$B \leqq 157^\circ - (360^\circ/n) \quad \text{(iv)}$$

where n is the number of outside working surfaces of bolts, nuts and fasteners for which the wrench is to function, and n is at least 3. In the most preferred embodiments, angles B are:

$$B \geqq 146^\circ - (360^\circ/n) \quad \text{(v)}$$

and are equal to or less than the angle calculated by the formula:

$$B \leqq 154^\circ - (360^\circ/n) \quad \text{(vi)}$$

where n is the number of outside working surfaces of bolts, nuts and fasteners for which the wrench is to function, and n is at least 3.

In the case of FIG. 2, the surface contact angle between $A_3$ and $A_4$ is approximately 90°, although angle B could be any of the angles within the ranges resulting from the above formulae.

Figure 3:
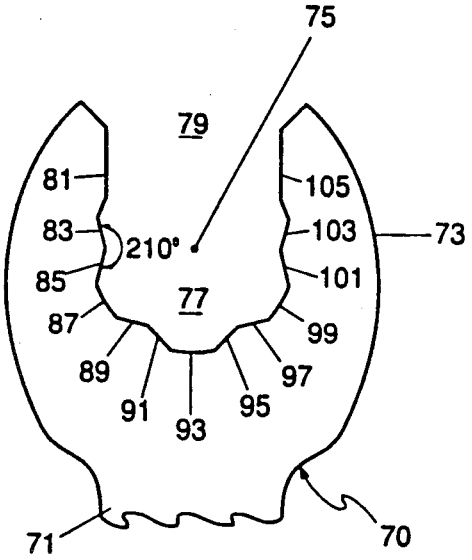
FIG. 3 is a front cut view of the present invention wrench shown in FIG. 2 but with a sizing feature.

FIG. 3 shows a cut front view of present invention open end wrench 70, having handle 71 and head 73. Imaginary central axis 75 is in orifice 77 with open end 79. Four pairs of inside working surfaces 83 and 85; 89 and 91; 95 and 97; 101 and 103, are included and are separated respectively by arcuated cut outs or curved surfaces 87, 93 and 99. Angles are as shown and the surface contact angles are 210°. Included in this wrench are sizing surfaces 81 and 105 for fitting about a nut, bolt or other fastener to confirm that the user has the correct size wrench for a particular job.

Figure 4:
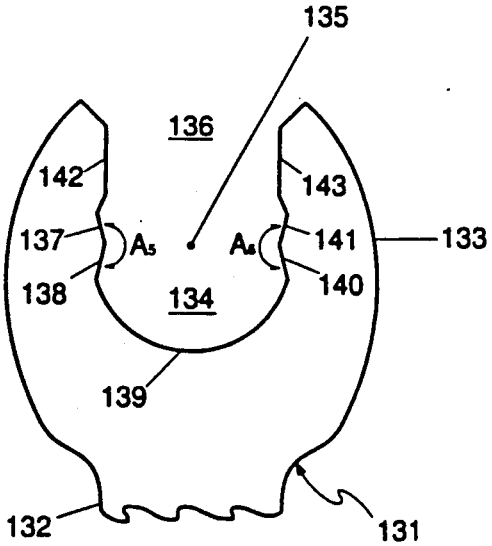
FIG. 4 is a present invention wrench having two pairs of flat inside working surfaces and includes a sizing feature.

Referring now to FIG. 4, there is shown a front cut view of a present invention wrench 131 with handle 132. Working wrench head 133 has an orifice 134 with open end 136 and imaginary central axis 135. Orifice 134 has two pairs of inside working surfaces. One pair formed by flat inside working surfaces 137 and 138 and the other by flat inside working surfaces 140 and 141. They are separated by curved surface 139, as shown.

Surfaces 137 and 138 form angle $A_5$ and surfaces 140 and 141 form angle $A_6$. Angle $A_5$ and $A_6$ may be the same or slightly different and are preferably the same. These angles are herein, surface contact angles having ranges greater than or equal to 200° but less than or equal to 220°.

Figure 5:
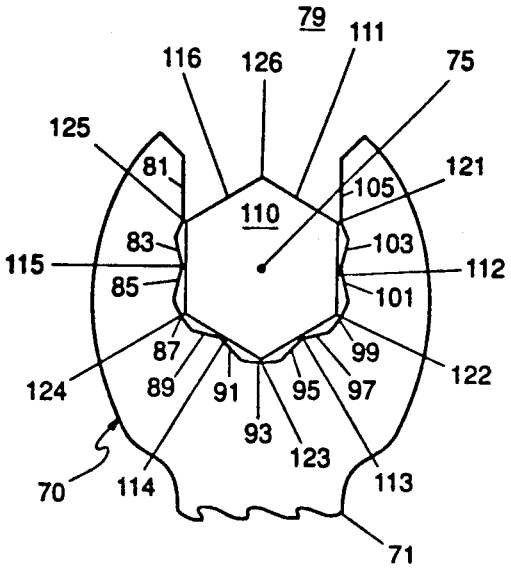
FIG. 5 shows the present invention wrench of FIG. 3 but with a hexagonal head bolt therein, prior to application of torque.
Figure 6:
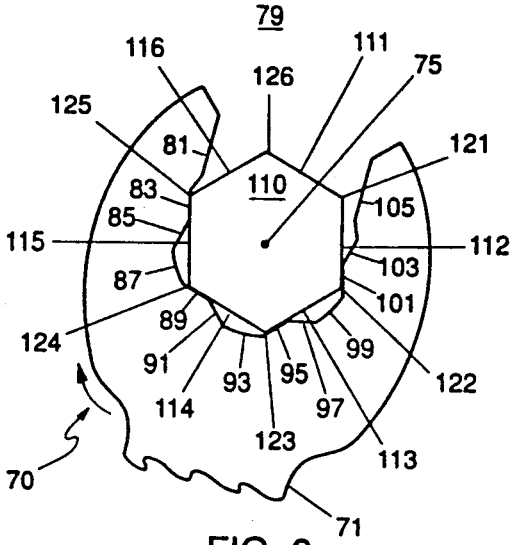
FIG. 6 shows the present invention wrench and bolt of FIG. 5 but with torque applied in a clockwise direction.

FIG. 5 shows the wrench 70 of FIG. 3, but with a hexagonal bolt 110 located therein, before torque is applied. FIG. 6 shows wrench 70 and bolt 110 again, but with strong torque applied to the handle 71, in a clockwise direction. Elements common to FIG. 3, 5 and 6 are identically numbered, are discussed above and need not be restated.

In FIGS. 5 and 6, bolt 110 has outside working surfaces 111, 112, 113, 114, 115 and 116 and corners or points 121, 122, 123, 124, 125 and 126. As can be seen in FIG. 5, bolt surface 115 is not in direct contact with, but adjacent to wrench inside working surfaces 83 and 85. Likewise, bolt surface 114 is similarly located relative to wrench inside working surfaces 89 and 91. Other bolt surfaces are similarly located relative to wrench surfaces 95 and 97 and surfaces 101 and 103.

In FIG. 6, where adequate torque is applied in a clockwise direction shown by the arrow, due to necessary free play between wrench and bolt head, metal yield and to the specifically defined contact surface angles, wrench inside working surfaces 83, 89, 95, and 101 come into full contact with the adjacent surfaces of bolt 111 to cause a preferred and superior surface-to-surface contact between bolt 111 and wrench 70. This provides for superior torque of the bolt 111 by wrench 70 and reduces or eliminates slippage, burring and wear on the fastener and the wrench.

If wrench 70 were rotated in the opposite direction, under torque, bolt surfaces would have surface-to-surface contact with the other wrench surface of each pair of wrench working surfaces, i.e. in this example, with surfaces 85, 91, 97 and 103.

Figure 7:
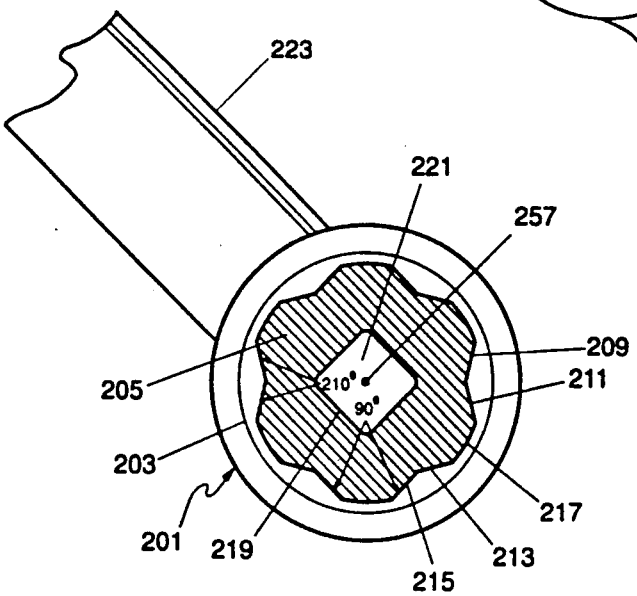
FIG. 7 shows a bottom view of a present invention socket for hexagonal fasteners.

FIG. 7 shows a present invention socket 201 with a base 203 and a recessed orifice 205. There is an imaginary central axis 207, about which six pairs of inside working surfaces are arranged, equidistant from one another and separated by clearance surfaces. For example, a typical pair of working surfaces are surfaces 209 and 211; another pair are surfaces 213 and 215. These are separated by a clearance surface 217 which may be curved or flat or otherwise. The pairs of working surfaces form surface contact angles of 210° as shown, and contiguous pair surfaces form an angle of 90°, in this particular embodiment. The angle between pairs is relative to fastener and the number of fastener sides, therefore the formulae would apply. Conventional ratchet driving means 221 has been inserted into square ratchet driving opening 219 and driving means 221 is connected to handle 223. It is removably connected to socket 201 in an conventional fashion.

Figure 8:
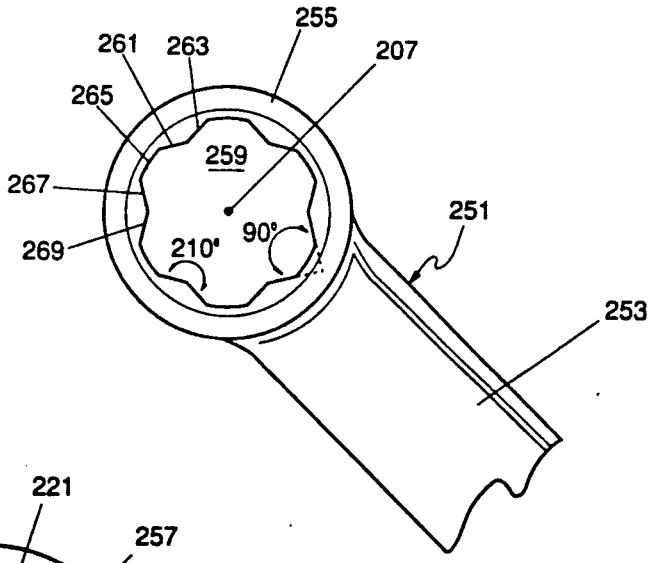
FIG. 8 shows a front view of a portion of a present invention box wrench.

Present invention box wrench 251 is shown in FIG. 8 in a cut front view, and includes handle 253 and head 255 with orifice 259 and center imaginary central axis 257. The six pairs of inside working surfaces are of the same configuration, angles and portions as these in wrench socket 201 of FIG. 7. These are typified by pair of surfaces 261 and 263, clearance surface 265 and surfaces 267 and 269. As with all of the present invention wrenches, the working surfaces and surface contact angles provide superior torquing of fasteners in the manner described in conjunction with FIGS. 5 and 6 above.

Figure 9:
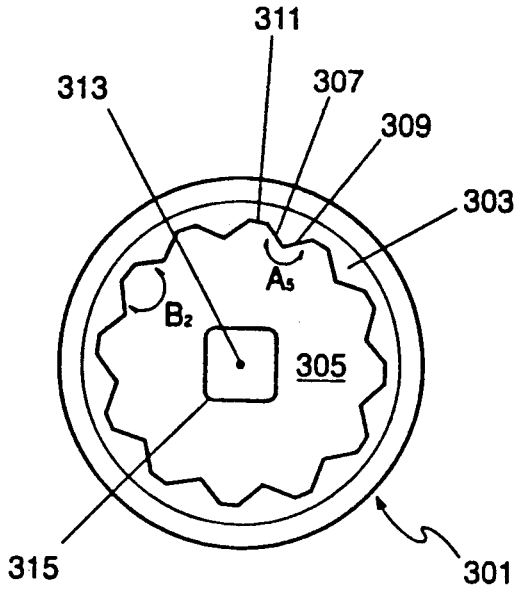
FIG. 9 shows a bottom view of a present invention socket for hexagonal fasteners with the socket having 12 pairs of working surfaces; and, FIG. 10 shows a front partial view of a present invention adjustable wrench.

FIG. 9 shows a bottom view of a present invention socket 301 having a ratchet (not shown), with base 303. Recess orifice 305 has twelve pairs of inside working surfaces which are typified by surfaces 307 and 309 and have adjacent to each such pair a clearance surface or radius surface 311. Surface contact angle $A_5$ is the angle formed by the surfaces of each pair. These are evenly arranged about imaginary central axis 313. Ratchet driving opening 315 is provided for use of a ratchet handle with the socket 301 shown in FIG. 9. Although the socket has 12 pairs of working surfaces, socket was designed for use with hexagonal fasteners to increase rotation and access under tight working conditions. Therefore, angle B as shown would be within the ranges of the formulae set forth earlier. $B \geqq 140° - (360°/n)$ and $B \leqq 160° - (360°/n)$. Angle B is 90° in this figure.

Figure 10:
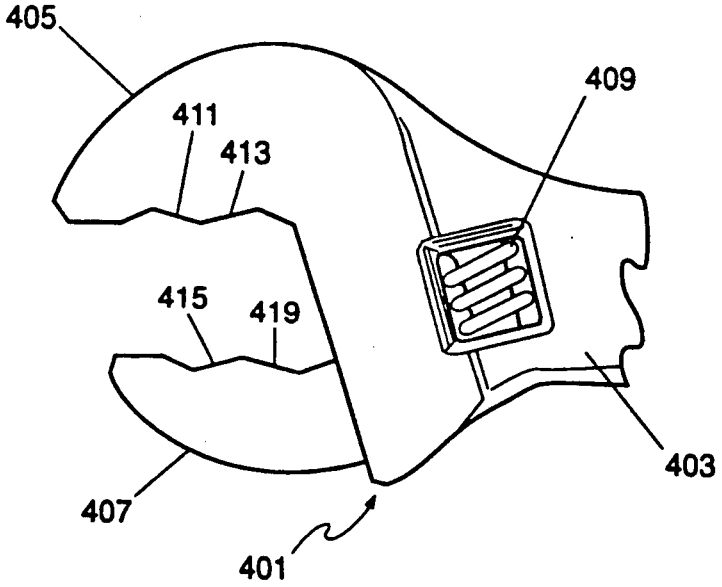

FIG. 10 shows present invention adjustable wrench 401 with handle 403 and a wrench head having a fixed section 405 and a moveable head section 407. Head portion 407 is movably connected to handle 403 in a conventional manner and threaded wheel 409 may be rotated toward section 405 or away from it to move head section 407 toward or away from section 405 to fit a particular nut, bolt or fastener. Two pairs of inside working surfaces formed by surfaces 411 and 413 and by surfaces 415 and 419. These pairs of surfaces form contact angles of 210° each and are designed for hexagonal type fasteners.

Obviously, numerous modifications and variations of the present invention are possible in light of the above teachings. It is therefore understood that within the scope of the appended claims, the invention may be practiced otherwise than as specifically described herein.

What is claimed is:

1. A wrench for tightening and loosening bolts, nuts and fasteners having a number of equal length outside working surfaces, which comprises:

(a) a working wrench head having an orifice which contains at least two pairs of flat inside working surfaces being arranged about and equidistant from an imaginary central axis through said orifice, each such surface of each pair forming a surface contact angle A with one another, whereby the surface contact angle A is equal to or greater than 203° and A is equal to or less than 217°; and, (b) a handle which is removably or permanently connected to said working wrench head adapted for rotation of said working wrench head.

2. The wrench of claim 1, wherein at least two pairs of inside working surfaces are directly opposite one another.

3. The wrench of claim 1, wherein said orifice is an open cut-out in said working wrench head to form an open-end wrench.

4. The wrench of claim 1, wherein said working wrench head is a closed-end to form a box wrench.

5. The wrench of claim 1, wherein said working wrench head is a socket wrench head.

6. The wrench of claim 1, wherein said working wrench head is formed of two opposite pieces connected to but positionally movable relative to one another so that to form an adjustable wrench head.

7. The wrench in claim 1, wherein said at least two pairs of flat inside working surfaces are taken from a pattern of equidistant pairs of flat inside working surfaces equal to the number of working outside surfaces of a fastener to which the wrench may be applied with a specified angle B, wherein B is an angle formed by two surfaces of said wrench, one each from a pair of adjacent flat contact surfaces wherein B can be determined by the formulae:

(iii) $B \geqq 143° - (360°/n)$ and, (iv) $B \leqq 157° - (360°/n)$ wherein n is the number of outside working surfaces of said fastener to which the wrench may be applied and n is at least three.

8. The wrench of claim 1, wherein said surface contact angle A is equal to or greater than 206° and is equal to or less than 214°.

9. The wrench of claim 8, wherein at least two pairs of inside working surfaces are directly opposite one another.

10. The wrench of claim 8, wherein said orifice is an open cut-out in said working wrench head to form an open-end wrench.

11. The wrench of claim 8, wherein said working wrench head is a closed-end to form a box wrench.

12. The wrench of claim 8, wherein said working wrench head is a socket wrench head.

13. The wrench of claim 8, wherein said working wrench head is formed of two opposite pieces connected to but positionally movable relative to one another so that to form an adjustable wrench head.

14. The wrench in claim 8, wherein said at least two pairs of flat inside working surfaces are taken from a pattern of equidistant pairs of flat inside working surfaces equal to the number of working outside surfaces of a fastener to which the wrench may be applied with a specified angle B, wherein B is an angle formed by two surfaces of said wrench, one each from a pair of adjacent flat contact surfaces wherein B can be determined by the formulae:

(v) $B \geqq 146° - (360°/n)$ and, (vi) $B \leqq 154° - (360°/n)$ wherein n is the number of outside working surfaces of said fastener to which the wrench may be applied and n is at least three.

15. A wrench head for attachment to a handle for rotation thereof which comprises a wrench head having an orifice having at least two pairs of inside flat working surfaces joined at points to form surfaces contact angles equal to or greater than 203°, and equal to or less than 217°, said pairs of flat surfaces being positioned around an imaginary axis through the center of said orifice.

16. The wrench head of claim 15, wherein said surface contact angles are greater than 206° and less than or equal to 214°.

17. The wrench head of claim 15, wherein said surface contact angles are approximately 210°.

18. The wrench head of claim 17, wherein an angle is formed between adjacent working surfaces from separate pairs which angle is approximately 90°.

19. The wrench of claim 15, wherein said pairs of working surfaces are separated by an arcuated cut-out.

20. The wrench of claim 17, wherein said pairs of working surfaces are separated by an arcuated cut-out.

21. A series of socket wrench heads having predetermined sequential sizing and each such head comprises a wrench head having an orifice having at least two pairs of inside flat working surfaces joined at points to form surface contact angles equal to or greater than 203°, and equal to or less than 217°, said pairs of flat surfaces being positioned around an imaginary axis through the center of said orifice.

22. The series of socket heads of claim 21, wherein said surface contact angles are greater than 206° and less than or equal to 214°.

23. The series of socket heads of claim 21, wherein said surface contact angles are approximately 210°.

24. The series of socket wrench heads of claim 23, wherein an angle is formed between adjacent working surfaces from separate pairs which angle is approximately 90°.

25. A wrench for tightening and loosening bolts, nuts and fasteners having a number of equal length outside working surfaces, which comprises:

(a) a working wrench head having an orifice which contains at least two pairs of flat inside working surfaces being arranged about and equidistant from an imaginary central axis through said orifice, each such surface of each pair forming a surface contact angle A with one another, whereby the surface contact angle A is predetermined;

(b) a handle which is removably or permanently connected to said working wrench head adapted for rotation of said working wrench head; and, further, wherein said at least two pairs of flat inside working surfaces form a specified angle B, wherein B is an angle formed by two surfaces, one each from a pair of adjacent flat contact surfaces wherein B can be determined by the formulae:

(i) $B \geqq 140° - (360°/n)$ and, (ii) $B \leqq 160° - (360°/n)$ wherein n is the number of outside working surfaces of said fastener to which the wrench may be applied and n is at least three.

26. The wrench of claim 25, wherein said orifice is an open cut-out in said working wrench head to form an open-end wrench.

27. The wrench of claim 25, wherein said working wrench head is a closed-end to form a box wrench.

28. The wrench of claim 25, wherein said working wrench head is a socket wrench head.

29. The wrench of claim 25, wherein the surface contact angle A is equal to or greater than 203° and A is equal to or less than 217°.

30. The wrench of claim 29, wherein said orifice is an open cut-out in said working wrench head to form an open-end wrench.

31. The wrench of claim 29, wherein said working wrench head is a closed-end to form a box wrench.

32. The wrench of claim 29, wherein said working wrench head is a socket wrench head.

* * * * *